US005551205A

United States Patent [19]

Kidder

[11] Patent Number: 5,551,205

[45] Date of Patent: Sep. 3, 1996

[54] MOUNTING FRAME CONSTRUCTION FOR A SHEET OF PLASTIC, SCREEN GUARD OR THE LIKE

[76] Inventor: Roger Kidder, 32072 Howard St., Madison Heights, Mich. 48071-1406

[21] Appl. No.: 285,163

[22] Filed: Aug. 3, 1994

[51] Int. Cl.[6] ..... E04C 2/42

[52] U.S. Cl. ..... 52/800.13; 52/799.1; 52/716.8

[58] Field of Search ..... 52/799.1, 800.12, 52/800.13, 800.14, 716.8, 204.5, 204.53, 204.591, 214

[56] References Cited

U.S. PATENT DOCUMENTS

| | | | |
|---|---|---|---|
| 2,111,448 | 3/1938 | Hoffman | 52/800.13 X |
| 3,349,533 | 10/1967 | Gregoire | 52/800.12 X |
| 3,363,390 | 1/1968 | Crane et al. | 52/716.8 |
| 3,452,501 | 7/1969 | Zimmer et al. | 52/800.12 X |
| 4,189,880 | 2/1980 | Ballin | 52/202 |
| 4,333,284 | 6/1982 | Meadows | 52/222 |
| 4,586,301 | 5/1986 | Hickman | 52/96 |
| 4,694,543 | 9/1987 | Conley | 24/461 |
| 4,695,499 | 9/1987 | Whitener | 52/716.8 X |
| 4,878,322 | 11/1989 | Ikeda | 52/2 |
| 4,926,605 | 5/1990 | Milliken et al. | 52/63 |
| 5,044,131 | 9/1991 | Fisher | 52/63 |
| 5,076,033 | 12/1991 | Patsy, Jr. | 52/222 |

FOREIGN PATENT DOCUMENTS

| | | | |
|---|---|---|---|
| 1102045 | 1/1968 | United Kingdom | 52/717.01 |

*Primary Examiner*—Carl D. Friedman
*Assistant Examiner*—Yvonne Horton-Richardson
*Attorney, Agent, or Firm*—Charles W. Chandler

[57] ABSTRACT

A frame for a mesh machine guard, or a pane of plastic, has a four-sided configuration, each side being formed of an extruded relatively rigid material having a channel shaped configuration, and an insert in each channel. Each insert is formed of a relatively soft resilient material and has one or more opposed flanges inclined in the direction in which the mesh is inserted in the frame. The resilient flanges wedge the mesh or pane in position in the insert to prevent the removal of the mesh or pane.

6 Claims, 2 Drawing Sheets

MOUNTING FRAME CONSTRUCTION FOR A SHEET OF PLASTIC, SCREEN GUARD OR THE LIKE

BACKGROUND OF THE INVENTION

This invention is related to a mounting frame for a generally planar object such as the mesh used for machine guards, sheet plastic, glass or the like.

Extrusions are commonly used in making storm window frames, fabric framing structures, signs and displays.

Examples of such frame structures may be found in U.S. Pat. Nos. 4,189,880 which was issued Feb. 26, 1980, to Gene Ballin for "Combination Mounting Frame and Film for a Window"; 4,333,284, which was issued Jun. 8, 1982, to David F. Meadows for "Extrusion and Building Structures"; 4,586,301 which was issued May 6, 1986, to John B. Hickman for "Retainer Clamp Membrane Fastening System"; 4,694,543, which was issued Sep. 22, 1987, to John L. Conley for "Sheet Gripping Assembly"; 4,878,322, which was issued Nov.7, 1989, to George Ikeda and William B. Walker for "Insulating Plastic Film Structures and Method"; 4,926,605, which was issued May 22, 1990, to Les Milliken and Blair Milliken for "Construction Assembly for Closure Structure"; 5,044,131, which was issued Sep. 3, 1991, to Larry Fisher for "Fabric Awning Assembly and Divider Bead For Use Therein"; and 5,076,033 which was issued Dec. 31, 1991, to Glorio J. Patsy, Jr. for "Method and Apparatus for Connecting Fabric Frame Structure Elements".

Typically the frame includes a channel shaped member of a relatively rigid material with an insert received in the channel member. A fabric material is often wrapped around the insert and is locked into the frame when the insert is inserted in the frame.

SUMMARY OF THE INVENTION

The broad purpose of the present invention is to provide an improved frame assembly for supporting a relatively rigid planar object such as the mesh commonly used for machine guards.

The preferred embodiment of the invention comprises a framing structure which includes an outer extruded frame section of a relatively rigid material having a channel-shaped configuration. One side of the channel has a longitudinal slot.

In one form of the invention useful for framing a pane of plastic in glass, the channel slot is defined by a pair of inwardly extending, resilient lips that are disposed at an acute angle with respect to the direction in which the pane is inserted into the channel. The two lips normally are spaced a distance less than the thickness of the pane. As the pane is inserted into the slot, the two lips bend away from one another, forming a sufficient frictional contact with the pane surface as to retard its removal from the channel.

In another embodiment of the invention, the outer channel has an integral inner rigid V-shaped channel which defines a longitudinal slot for receiving a stiff mesh. An insert of a resilient softer material is disposed in the V-shaped channel. The insert has multiple pairs of opposed cantilever-supported flanges. The inner edge of each flange forms a relatively thin lip. Each lip has a surface inclined in the direction in which the mesh is inserted into the insert. When the mesh is inserted between the flanges, the lips are forced apart until the mesh is fully inserted. Any attempt to remove the mesh causes it to wedge with the flanges between the sides of the V-shaped channel thereby preventing its removal.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 2:
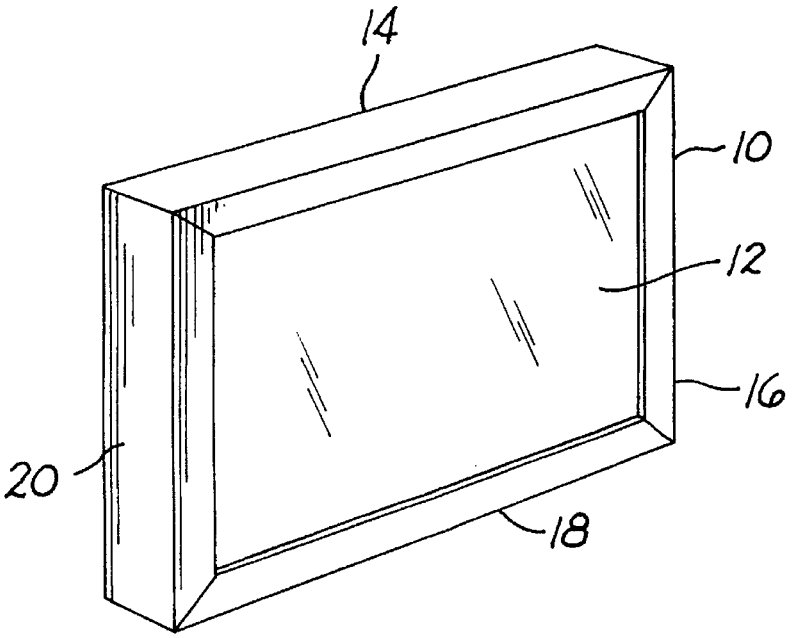
FIG. 2 is a view of a storm window having a frame illustrating the preferred embodiment of the invention.
Figure 3:
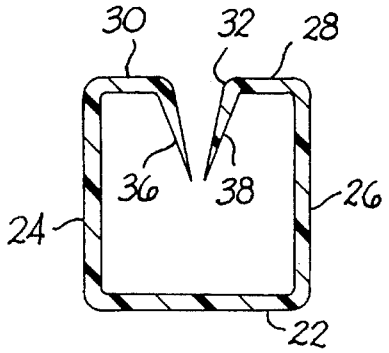
FIG. 3 is an enlarged cross-sectional view of the frame of FIG. 2 with the pane of glass removed.
Figure 4:
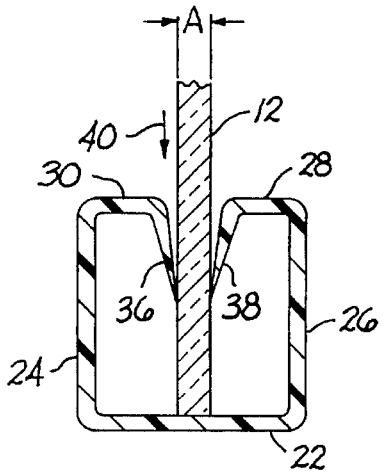
FIG. 4 is a view similar to FIG. 3 but with the pane inserted into the frame.

Referring to the drawings and in particular FIGS. 2–4, a frame 10 for supporting a transparent plastic pane 12 comprises four frame elements, 14, 16, 18, and 20. The four frame elements have an identical cross-section, are each formed of a relatively stiff polyvinyl plastic extrusion and are joined at their corners by any suitable means such as an adhesive, a mechanical connector or the like.

Referring to FIGS. 3 and 4, a typical cross-section of the four frame elements comprises a hollow extruded section having a base wall 22, a pair of upstanding side walls 24 and 26 integrally joined to opposite sides and at right angles to the base wall. A pair of flanges 28 and 30 are integrally attached to the upper edges of the side walls, parallel to base wall 22. The width of the frame element is about 1½" and the height is about 1½".

Flanges 28 and 30 define a slot 32 for receiving pane 12. A pair of integral tapered lips 36 and 38 extend inwardly from the inner edges of flanges 28 and 30. The inside free edges of the two flanges are spaced a distance greater than the thickness "A" of pane 12. Lips 36 and 38 are supported in a cantilever fashion from their respective flanges 28 and 30, and are relatively moveable with respect to one another. The two lips, that is where they join flanges 28 and 30, are spaced a distance greater than the thickness of pane 12.

Referring to FIG. 4, lips 36 and 38 extend inwardly about half of the height of the side walls. When pane 12 is inserted into the slot between the two flanges, the lips permit the easy insertion of the lips because they are bent in the direction of insertion 40. However, when the pane is fully inserted, the lips then form a sufficient frictional engagement with the sheet retarding its removal because the lips cannot bend in the reverse direction because of the pressure of the pane.

In summary, each frame element is formed of a relatively thin walled structure with the walls being rigid but the lips 36 and 38 being resilient and slightly flexible.

Figure 1:
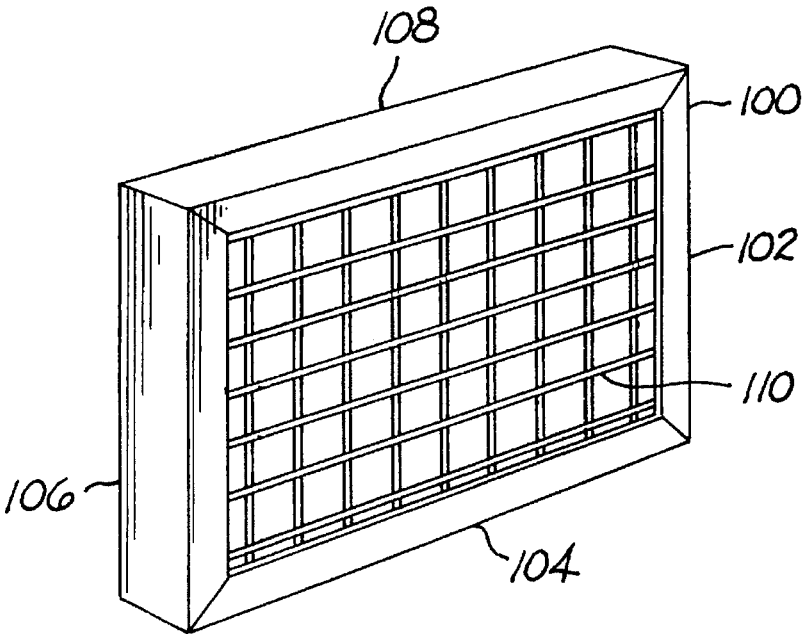
FIG. 1 is a view of a machine guard having an extruded frame supporting a wire mesh.
Figure 5:
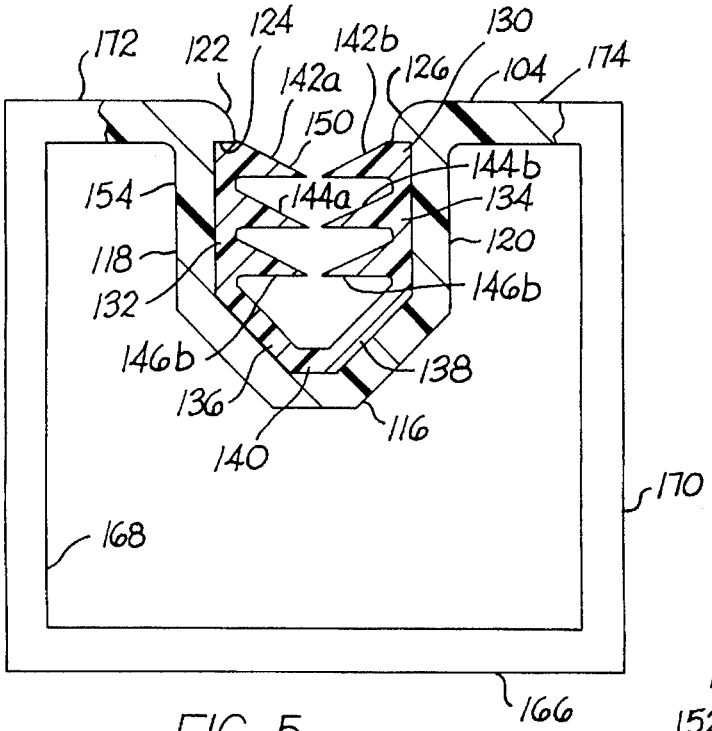
FIG. 5 is an enlarged cross sectional view of the frame of FIG. 1 with the mesh removed.
Figure 6:
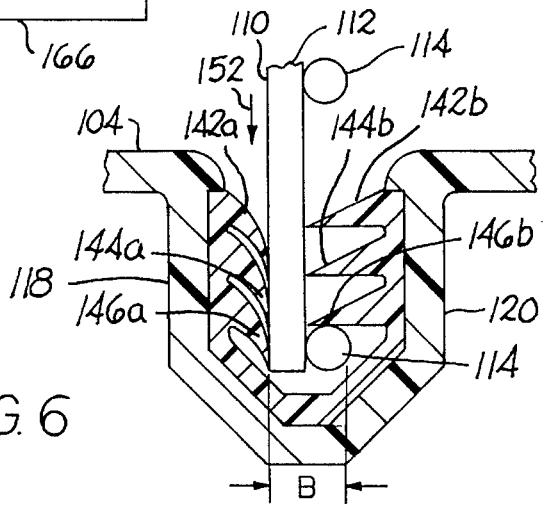
FIG. 6 is a view similar to FIG. 5 but with the edge of the mesh inserted into the frame insert.

Referring to FIGS. 1, 5 and 6, mesh guard 100 has a rigid four sided frame comprising frame elements 102, 104, 106 and 108. All the frame elements have the same cross-sections.

A stiff wire mesh 110, commonly used as a machine guard material, is bounded by the frame elements. Referring to FIGS. 1 and 6, mesh 110 comprises a series of spaced, parallel vertical wire rods 112 attached to a series of spaced, parallel horizontal rods 114. The mesh has a generally planar configuration.

FIGS. 5 and 6 illustrate a typical cross section of frame element 104. Frame element 104 is extruded of relatively rigid polyvinyl chloride plastic material. Frame element 104 includes a base wall 166 attached to a pair of integral, parallel side walls 168 and 170. A pair of short flanges 172 and 174 extend from the upper edges of side walls 168 and 170 toward one another. Flanges 172 and 174 are parallel to base wall 166. The overall height and width of the extrusion cross section is about 1.5". A V-shaped small channel 116 is disposed between side walls 168 and 170 and includes a pair of short walls 118 and 120 which are joined to flanges 172 and 174 slightly outward of longitudinal slot 122. The joinder between walls 118 and 120 and the top flanges 172 and 174 form a pair of opposed lips 124 and 126 which define the width of the slot. The slot width is greater than the overall thickness "B" of the wire mesh. The mesh thickness includes the combined thickness of rods 112 and 114.

An extruded insert 130 of a softer material is snapped into channel 116 and trapped between walls 118 and 120 by lips 124 and 126. Insert 130 has an outside configuration that is complementary to the inside configuration of channel 116. The insert has a pair of side walls 132 and 134. The upper edges of the two side walls engage lips 124 and 126. The bottom of the insert has a pair of inclined convergent walls 136 and 138 connected by a short horizontal wall 140 to form a generally V-shaped configuration.

Three pairs of exposed flanges 142A and 142B, 144A and 144B, and 146A and 146B, are joined in a cantilever fashion from side walls 132 and 134. Each flange is tapered to have a triangular cross section. The inner edges of each pair of flanges are spaced about 0.010" apart. Each flange has an outside surface 150 facing slot 122 and inclined to form an acute angle with respect to the direction of the mesh insertion 152. The inside surface 154 of flange 142A, is disposed in a plane that is transverse to the direction of insertion 152. The inside surface of each flange is disposed in a similar plane. Each flange is resilient.

Referring to FIG. 6, when stiff mesh 112 is inserted into the insert, the mesh initially engages the inclined surfaces of each flange. Bar 114 of the mesh passes the three flanges on the right as illustrated in FIG. 6. Each flange then snaps back behind bar 114. The flanges on the left slidably engage each vertical bar 112 and bend with the bar. When the mesh is fully inserted in the insert, the flanges retard withdrawal of the mesh because the flanges become wedged with the insert between the rigid walls 168 and 170.

Similarly, should a pane of glass or plastic be inserted into the insert, the three flanges readily permit the pane to be inserted. However, withdrawal of the pane will be frictionally retarded by the flanges because the angle of each flange, as illustrated in FIG. 6, because the flanges cannot readily bend in the opposite direction, toward slot 122 because of the pressure of the plane. Since this frictional resistance is applied along the entire length of the flanges which extend substantially the same length as frame element 104, the pane is releasably locked in position. The flanges in effect form a wedged configuration with the pane preventing its withdrawal.

Although three pairs of flanges are illustrated, fewer flanges can be used. The multiple number provide a greater or lesser frictional resistance to withdraw the pane, and also accommodate variations in the dimensions of the pane on the mesh. The prepared structure provides a quick and easy method for framing a relatively rigid material. The frame is lightweight, inexpensive and extremely effective.

Having described my invention, I claim:

1. A mounting frame structure for a generally planar, rigid object having a known thickness, comprising:

an outer channel of a relatively rigid stiff material, and an inner channel of a relatively rigid stiff material located within said outer channel;

said outer channel comprising two side walls (168, 170) and two inturned flanges (172, 174) extending from said side walls;

said inner channel comprising two side walls (118, 120) extending from said inturned flanges;

a unitary one piece insert of a relatively soft resilient material located within said inner channel;

said insert having an outer surface configuration that is complementary to the inner surface configuration of said inner channel, whereby said inner channel supports said insert in a stationary position;

said insert having two internal opposed resilient deflectable flanges having terminal ends normally spaced a distance less than the thickness of said rigid object, so that when an edge area of said object is moved into the space between said flanges, the flanges are deflected to exert a wedge clamp action on the planar object; and said insert being adapted to completely encircle the edge area of the planar object.

2. The frame structure of claim 1, wherein said outer channel and said inner channel constitute an integral one piece extrusion formed of a rigid plastic material.

3. The frame structure of claim 1 wherein said inturned flanges (172, 174) extend toward each other beyond the side walls of said inner channel to form two opposed overhanging lips (124, 126); and said one piece insert being located within said inner channel in abutting relation to said overhanging lips, whereby the lips act as mechanical retainers for the insert.

4. The frame structure of claim 1, wherein said inner channel comprises a V-shaped web wall joined to the respective side walls; said one piece insert having two convergent walls (136, 138) of the same convergency as said V-shaped web wall, whereby said inner channel provides a stable back-up support for the insert.

5. The frame structure of claim 1, wherein said insert comprises two side walls (132, 134) lying against the side walls of said inner channel;

said resilient deflectable flanges extending from said side walls of the insert, and having terminal ends normally spaced a distance less than the thickness of the planar object; each of said flanges having a triangular cross section so that its terminal end is tapered.

6. The frame structure of claim 1, and further comprising a planar rigid object having an edge area thereof installable in said insert;

said planar rigid object comprising a stiff wire mesh member having first wire rods (112) extending parallel to the direction of movement of the object into said insert and second wire rods (114) extending normal to the direction of movement of the object into said insert;

said insert being dimensioned so that when the edge area of the wire mesh member is moved into the insert, one of said second wire rods ratchets across one of the resilient flanges to assume a position wherein said one flange prevents reverse movement of said one wire rod out of the insert.

* * * * *